US005107431A

United States Patent [19]

Ohta et al.

[11] Patent Number: 5,107,431

[45] Date of Patent: Apr. 21, 1992

[54] FUEL CONTROL SYSTEM FOR MODIFYING FUEL INJECTION ACCORDING TO TRANSMISSION TYPE AND ACCELERATION

[75] Inventors: Yuji Ohta; Yukio Masuda; Kazutomo Sasaki; Kenji Katayama, all of Hiroshima, Japan

[73] Assignee: Mazda Motor Corporation, Hiroshima, Japan

[21] Appl. No.: 506,612

[22] Filed: Apr. 10, 1990

[30] Foreign Application Priority Data

Apr. 10, 1989 [JP] Japan ..... 1-93323

[51] Int. Cl.[5] ..... F02D 41/06; F02D 41/10

[52] U.S. Cl. ..... 364/431.1; 364/431.04; 364/431.07; 123/480; 123/491; 123/492

[58] Field of Search ..... 364/431.03, 431.04, 364/431.05, 431.07, 431.1; 123/478, 491–493, 480, 339

[56] References Cited

U.S. PATENT DOCUMENTS 4,345,557 8/1982 Ikeura ..... 123/339
4,939,658 7/1990 Sekozawa et al. ..... 364/431.05 X
4,951,206 8/1990 Kyohzuka ..... 364/431.05 X

FOREIGN PATENT DOCUMENTS 49-45656 12/1974 Japan .

*Primary Examiner*—Parshotam S. Lall
*Assistant Examiner*—E. J. Pipala
*Attorney, Agent, or Firm*—Fleit, Jacobson, Cohn, Price, Holman & Stern

[57] ABSTRACT

An automotive engine is provided with a fuel control system having a fuel injector for injecting a properly controlled quantity of fuel into cylinders of the automobile engine. The control system is adapted to cause the fuel injector to inject an increased quantity of fuel when an engine control value, relative to which the automotive engine changes its speed of rotation for a decision as to whether the automotive engine is in an acceleration state, is higher than a critical level. The control system also detects the transmission coupled to the automobile engine, and changes, when a temperature of the automotive engine is lower than a preselected temperature, the critical level according to the type of transmission detected.

10 Claims, 5 Drawing Sheets

FUEL CONTROL SYSTEM FOR MODIFYING FUEL INJECTION ACCORDING TO TRANSMISSION TYPE AND ACCELERATION

The present invention relates to a fuel control system for an automotive engine, and more particularly, to a fuel control system for increasingly varying the amount of fuel delivered into an automobile engine while an automobile is under acceleration.

BACKGROUND OF THE INVENTION

A fuel control system of this type is typically adapted to asynchronously inject fuel in an amount greater than that ordinarily required during acceleration, thereby preventing a fuel mixture from becoming temporarily lean, due to a slow detection of intake air by an air-flow meter upon acceleration. In an attempt at preventing the fuel mixture from being difficult to gasify or vaporize before the engine has warmed up and, accordingly, be more lean upon acceleration, the fuel control system is adapted to inject fuel in an increased fuel amount during acceleration, so as to prevent the fuel mixture from becoming lean. Such an intake system is known from Japanese Patent Publication No. 49(1974)-45655, entitled "Injection Type Fuel Distribution Apparatus," published Dec. 5, 1974.

Such a fuel control system as that described in the above publication generally judges the acceleration of automobile by detecting, for example, an increase of intake air greater than a standard increase. In this fuel control system, because fuel is apt to be difficult to gasify or vaporize before the engine warms up and, accordingly, has an increased viscosity, the fuel mixture becomes lean immediately after the start of automobile when an increase of intake air is smaller than the standard increase level or upon quick and slight acceleration. In such cases, the fuel control system can not judge wheter the automobile is subjected to acceleration, resulting in not injecting fuel with an increase in fuel amount and in failing to prevent the fuel mixture from becoming lean.

SUMMARY OF THE INVENTION

It is, therefore, a primary object of the present invention to provide a fuel injection control system in which a fuel mixture is maintained at desired air-fuel ratios by changing a critical level of a change of intake air, according to temperatures of the engine, for acceleration judgement.

The object of the present invention is achieved by a fuel control system having fuel injection control means for distributing or injecting a properly controlled quantity of fuel into cylinders of the automobile engine. The fuel control system is provided as a unit to cooperate with either an automobile engine with a manual transmission or an automobile engine with an automatic transmission. The fuel control system comprises engine control value detection means for detecting an engine control value by which the automotive engine changes its speed of rotation to decide if the automotive engine is in an acceleration state, a temperature sensor for detecting when temperatures of the automotive engine are lower than a preselected temperature and, when they are, for providing a signal, fuel increase means for causing the fuel injection means to inject an increased quantity of fuel when the engine control value detection means detects an engine control value higher than a critical level, transmission type detecting means for detecting the type of transmission coupled to the automobile engine, and level change means for, when said temperature sensor detects a temperature lower than a preselected temperature, changing the critical level according to the type of transmission detected by the transmission type detecting means.

The level change means automatically makes the critical level lower for an automobile engine with an automatic type of transmission than for an automobile engine with a manual type of transmission.

The engine control value detection means is preferably an air flow meter disposed in an intake passage for detecting an increase of intake air to be delivered into the cylinders.

The fuel control system preferably further has means for, while the automobile engine is idling, disabling the engine control value detection means for deciding if the automotive engine is in an acceleration state for a predetermined time period when the transmission type detecting means detects a manual type of transmission.

BRIEF DESCRIPTION OF THE DRAWINGS

Still other objects of the invention and more specific features will become apparent to those skilled in the art from the following description of the preferred embodiment when considered together with the accompanying drawings, wherein like reference characters have been used in the different figures to denote the same parts, and in which.

DESCRIPTION OF THE PREFERRED EMBODIMENT

Because vehicle engines are well known, the present description will be directed to particular elements forming parts of, or in cooperation directly with, the system in accordance with the present invention. It is to be understood that elements not specifically shown or described can take various forms well known to those skilled in the automobile engine art.

Figure 1:
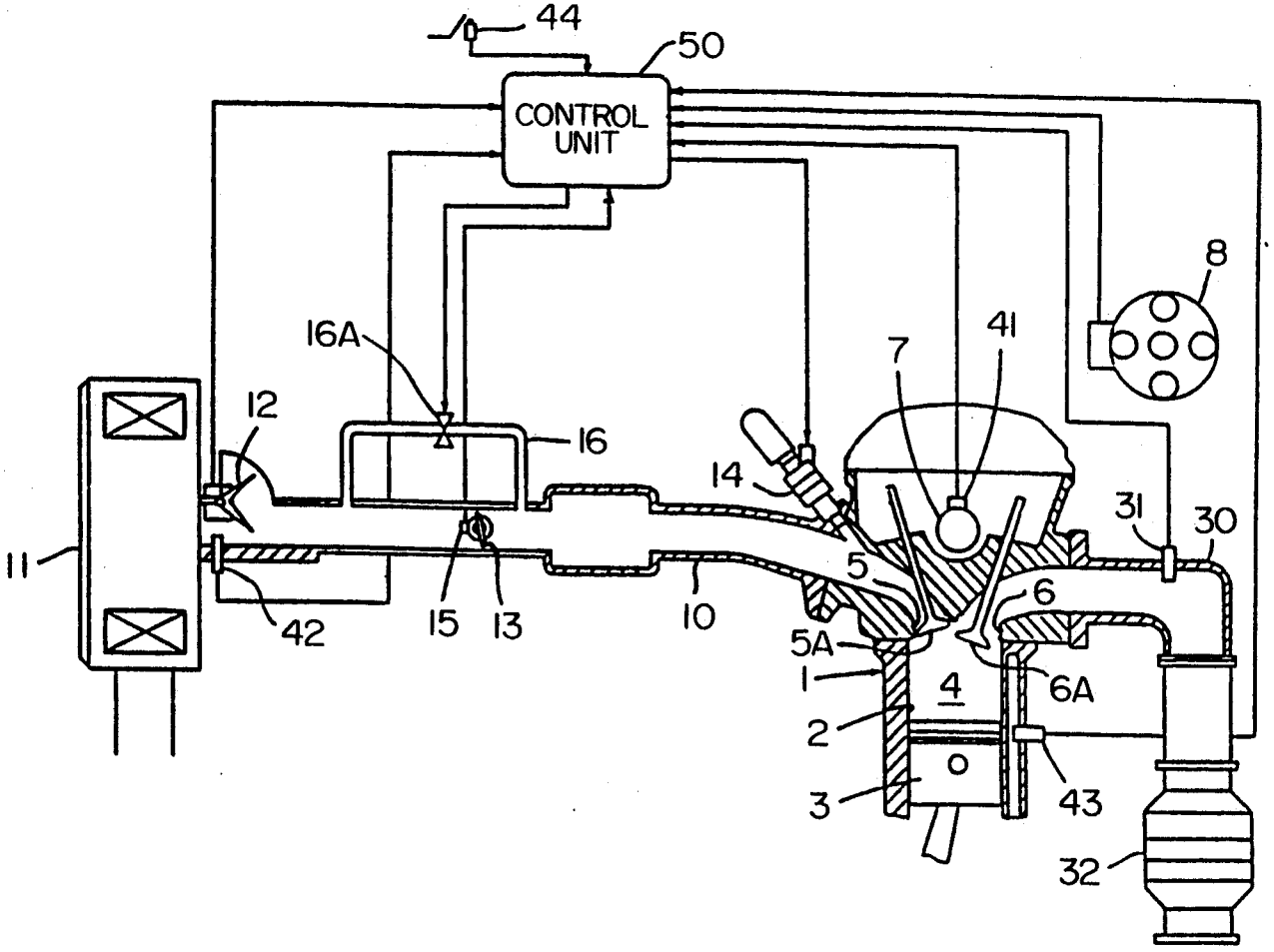
FIG. 1 is a schematic illustration showing an automobile engine with a fuel control system in accordance with a preferred embodiment of the present invention.

Referring to the drawings in detail, and particularly to FIG. 1, an automobile engine having an intake system in accordance with a preferred embodiment of the present invention is shown. The automobile engine has an engine block 1 formed with a cylinder 2 slidably receiving a piston 3 which forms combustion chamber 4 therein. Facing the combustion chamber 4, there are disposed intake and exhaust valves 5A and 6A respectively seated in intake and exhaust ports 5 and 6 formed in the engine block 1. These intake and exhaust valves 5A and 6A are timely driven by a cam shaft 7 to open and close the intake and exhaust ports 5 and 6. A spark plug (not shown), which is threaded into the engine block 1 at the top of the combustion chamber 4 and which cooperates with a distributor 8, constitutes a firing system well known in the art. The combustion chamber 4 is in communication with intake and exhaust manifolds 10 and 30.

The intake manifold 10, connecting an air cleaner 11 to the combustion chamber 4, is provided, in order, with an air-flow sensor 12 disposed adjacent to the air cleaner 11 for detecting the amount of intake air, a throttle valve 13 following the air-flow sensor 12 for controlling quantity of air reaching the combustion chamber 4, and a fuel injector 14 disposed adjacent to the intake port 5 for controlling the quantity of fuel. It is to be noted that in this embodiment, the air-flow sensor 12 is used as an engine control value detection means, i.e., an acceleration detector for judging the acceleration of engine by metering the amount of intake air as an acceleration judging parameter. In association with the throttle valve 13, a throttle opening sensor 15 is provided to send an appropriate output signal indicating the opening of the throttle valve 13 to a microcomputer as an engine control unit 50. The intake manifold 10 is further provided with a bypass passage pipe 16 with an idle speed control (ISC) valve 16A, which allows part of the intake air flow to bypass the throttle valve 13 so as to supply supplementary air into a downstream part of the intake manifold 10.

The exhaust manifold 30, connecting the combustion chamber 4 to a catalytic converter 32 for significantly lowering emission levels of hydrocarbons, carbon monoxide, and, in the case of some converters, oxides of nitrogen, as is well known in the art, is provided with an oxygen sensor 31 near the exhaust port 6.

The engine control unit 50 receives signals from a crank angle sensor 41 provided in association with the cam shaft 7 for detecting engine speed, an intake air temperature sensor 42 provided in association with the air-flow sensor 12, and engine coolant temperature sensor 43 and an idle sensor 44 which is kept turned on when the engine is idling, as well as from the air-flow sensor 12, throttle opening sensor 15 and oxygen sensor 31.

Figure 2:
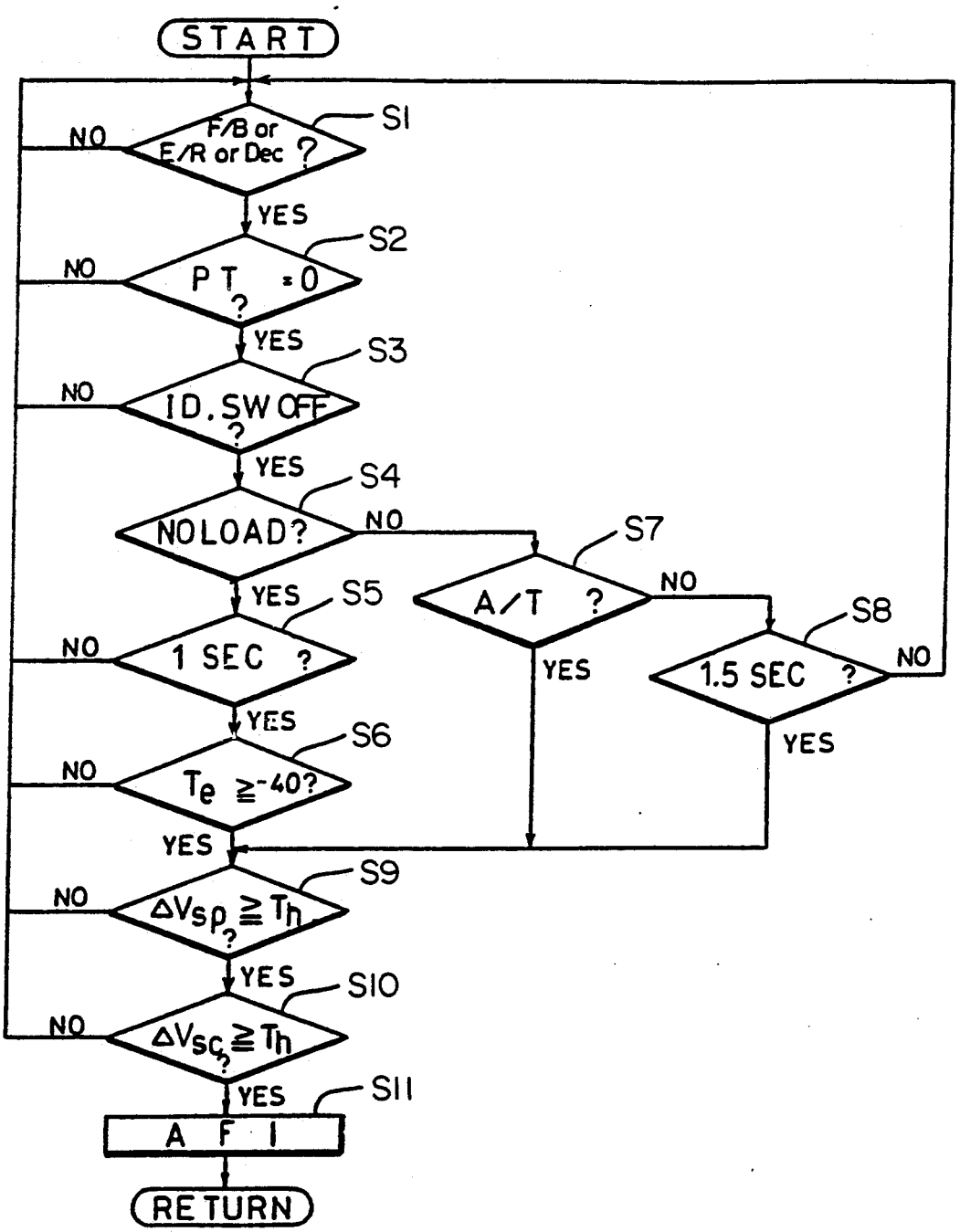
FIG. 2 is a flow chart illustrating an asynchronous fuel injection judgement routine or sequence for a microcomputer.
Figure 4:
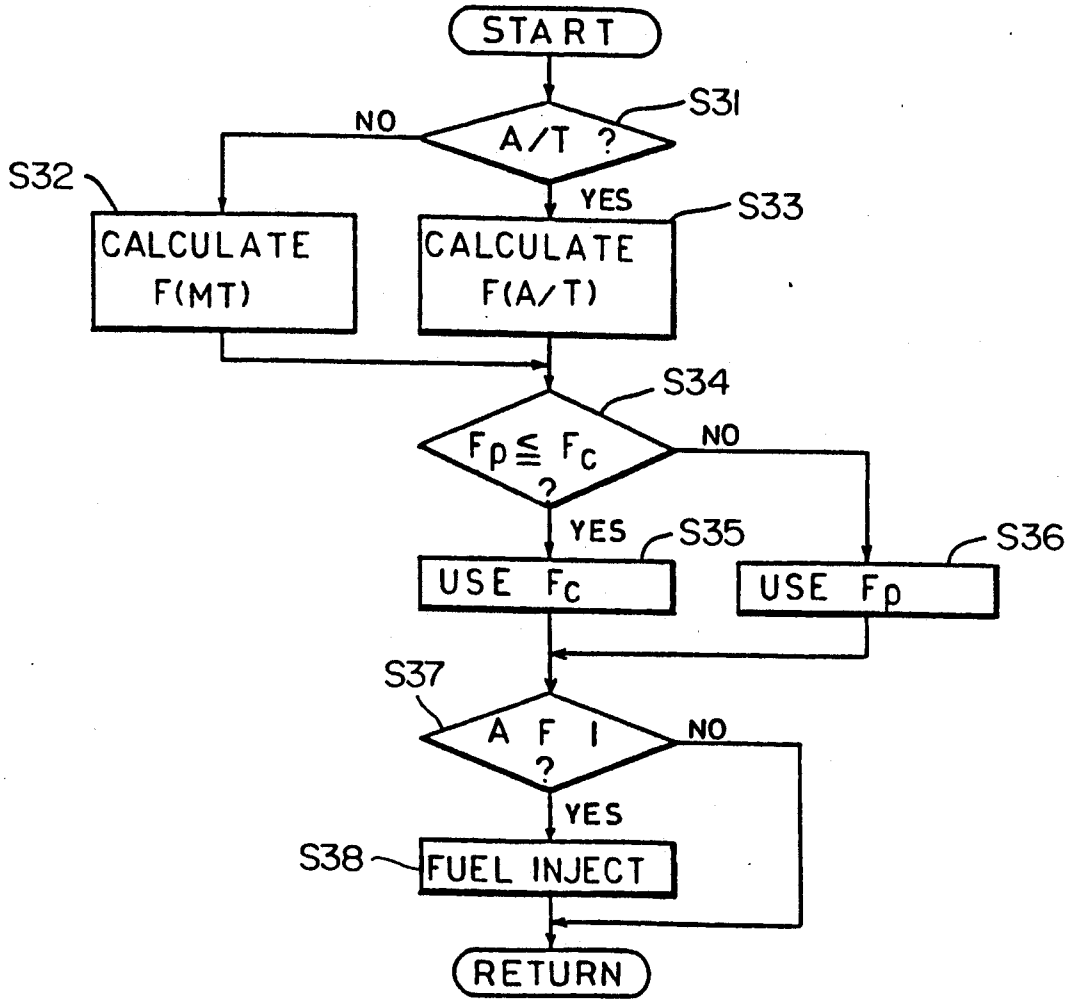
FIG. 4 a flow chart of an asynchronous fuel injection sequence for the microcomputer.
Figure 3:
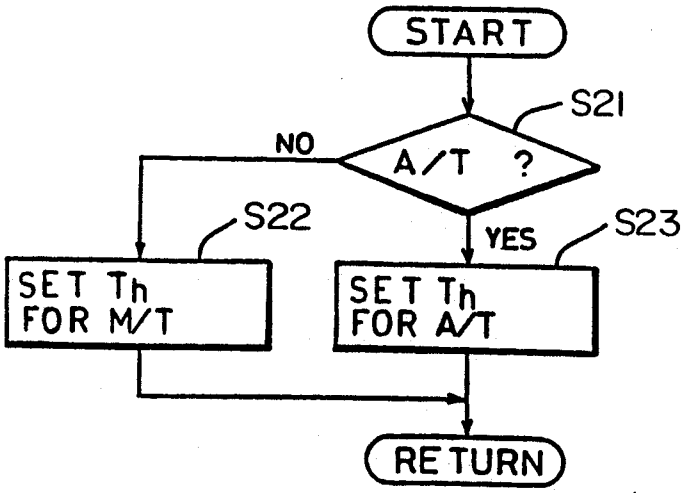
FIG. 3 is a flow chart illustrating a critical level setting sequence for the microcomputer.

The operation of the fuel control system depicted in FIG. 1 is best understood by reviewing FIGS. 2 to 4, which are flow charts illustrating various sequences for the microcomputer of the control unit 50. Programming a computer is a skill well understood in the art. The following description is written to enable a programmer having ordinary skill in the art to prepare an appropriate program for the microcomputer. The particular details of any such program would, of course, depend upon the architecture of the particular computer selected.

Referring to FIG. 2, which is a flow chart of the asynchronous injection judgement sequence, the first step in step S1 is to make a decision whether the operating condition of the engine is in a fuel cut zone or deceleration zone or whether the engine is at the beginning of starting. The decision made in step S1 is repeated until the yes decision is provided. If, in fact, the answer to the decision is yes, this indicates that the engine is not under acceleration or that the engine has not been warmed up. Then, a decision is made in step S2 as to whether or not a prohibition timer (PT) indicates a count of zero (0). The fuel control system is adapted to prohibit the first detection of acceleration for a certain time period after a predetermined number of asynchronous fuel injections. As long as the prohibition timer (PT) determines that the prohibition of asynchronous fuel injection is still occurring during acceleration, the first and second decisions in steps S1 and S2 are repeatedly made. If the prohibition timer (PT) has counted down and there is no prohibition of asynchronous fuel injection, a decision is made in step S3 as to whether the idle sensor (ID.SW) 44 is turned off. This decision is made in order to avoid the misjudgment of acceleration resulting from the fluctuations of an output signal from the air-flow sensor 12 during idling. If the idle sensor (ID.SW) 44 is turned on, this indicates that because of engine idling, no increase in fuel amount is required, and then, the asynchronous injection judgement sequence orders a return to the first decision in step S1.

If the idle sensor 44 is turned off, this indicates that the engine is possibly loaded. A decision is then made in step S4 as to whether the engine is still loaded. If the answer to the decision is yes, indicating that there is no engine load, then, a decision is made in step S5 as to whether a one-second time period has elapsed after the disappearance of engine load. If the answer to the decision is no, the asynchronous injection judgement sequence orders a return to the first decision in step S1 without increasing the amount of fuel. This is because it is presumed that the disappearance of engine load results from having shifted the transmission 2 to its neutral range. Therefore, it is necessary to avoid misjudging the engine as being under acceleration if a rapid increase in engine speed after a speed range shift operation is detected. On the other hand, if the one second time period has elapsed, a decision is made in step S6 as to whether the temperature of engine coolant Te is lower than −40° C. If the answer to the decision indicates an engine coolant temperature of lower than −40° C., the asynchronous injection judgement sequence orders a return to the first decision in step S1 without increasing the amount of fuel. This is because, an increase in the fuel amount upon acceleration would certainly make the fuel mixture too rich, since the fuel system otherwise generally increases a basic amount of injected fuel when the temperature of the engine coolant Te is lower than −40° C. If the answer to the decision in step S6 is yes, decisions regarding changes of the intake air amount ΔVs are made in steps S9 and S10.

If the answer to the decision in step S4 regarding engine load is no, this indicates the engine is loaded. Then, a decision is made in step S7 as to whether the transmission 2 is automatic (abbreviated by A/T) or manual (abbreviated by M/T). If it is decided that the transmission 2 is automatic, the decisions regarding changes in the intake air amount are made in steps S9 and S10. On the other hand, if it is decided that the transmission 2 is manual, a decision is made in step S8 as to whether a one and one-half second time period has elapsed after the disappearance of engine load. If the answer to the decision is no, this indicates that the speed of the engine is not yet stable. The asynchronous injection judgement sequence then orders a return to the first decision in step S1 without increasing the amount of fuel in order to avoid the misjudgment of acceleration. If the answer to the decision regarding the elapse of the one and half-second time period is yes, the decisions regarding changes of intake air amount are made in steps S9 and S10.

The decisions made in steps S9 and S10 are made in order to decide whether a previous change of intake air amount ΔVsp per unit time and a current change of intake air amount ΔVsc per the unit time are equal to or larger than a specific value Th, respectively. If either the previous or the current change in intake air amount is smaller than the specific value Th, the asynchronous injection judgement sequence orders a return to the first decision in step S1 without increasing the amount of fuel for the presumable judgement of no demand for acceleration. On the other hand, if both the previous and current changes of intake air amount per unit time are equal to or larger than the specific value Th, an asynchronous fuel injection flag AFI is set in step S11 to execute an asynchronous fuel injection, since the engine has a demand for acceleration. The continuous decisions in steps S9 and S10 prevent a misjudgment of acceleration due to fluctuations of an output signal from the air-flow sensor 12.

Figure 5:
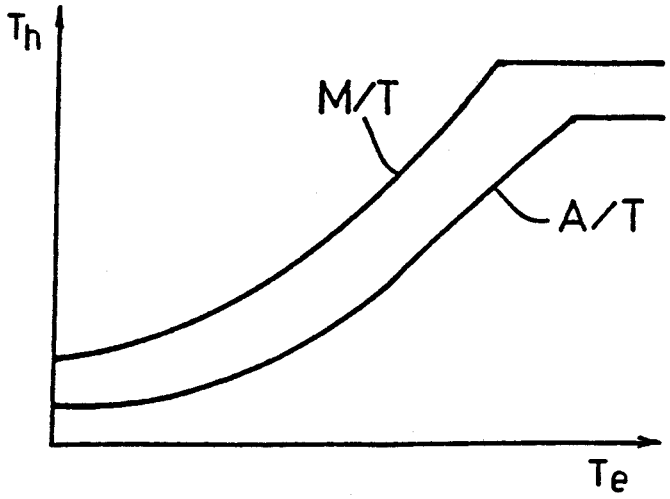
FIG. 5 is a diagram showing the relationship of a critical value relative to a temperature of engine coolant.
Figure 8:
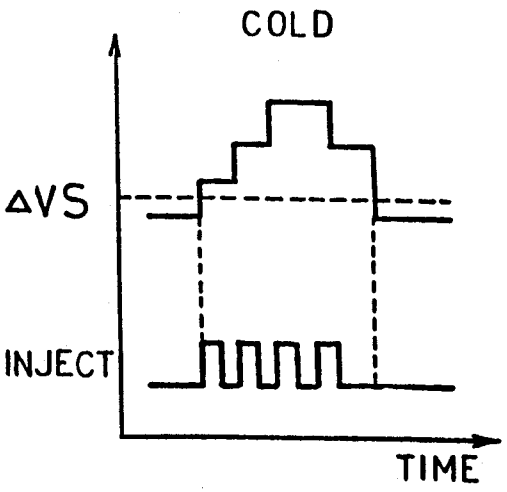
FIG. 8 is a diagram showing the relationship of the number of asynchronous fuel injections relative to a change of intake air amount before an automobile engine has warmed up.
Figure 7:
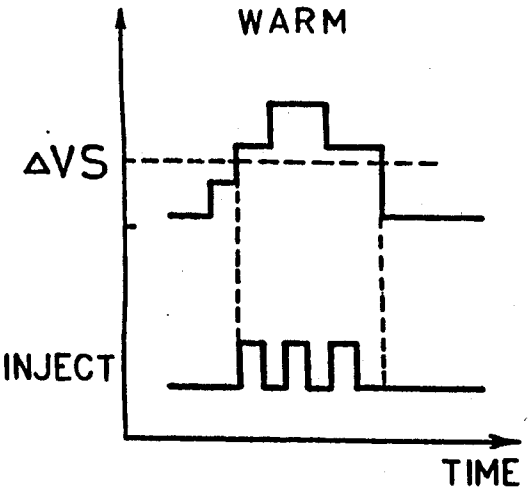
FIG. 7 is a diagram showing the relationship of the number of asynchronous fuel injections relative to a change of intake air amount after an automobile engine has warmed up.

Referring to FIG. 3, which is a flow chart of the critical level setting sequence, the first step in step S21 is to make a decision as to whether the transmission 2 is automatic (A/T) or manual (M/T) to set the specific value Th suitably for the type of the transmission 2. If it is determined that the transmission 2 is automatic, an appropriate specific value Th is drawn from a specific value curve A/T shown in FIG. 5, according to the temperature of engine coolant Te, in step S22. Otherwise, if it is determined that the transmission 2 is manual (M/T), an appropriate specific value Th is drawn from a specific value curve M/T shown in FIG. 5, according to the temperature of engine coolant Te in step S23. As is apparent from FIG. 5, the specific value Th is established so as to be higher over the whole range of temperatures of engine coolant Te for the manual transmission than for the automatic transmission. This is because the automatic transmission is subjected to a larger load than the manual transmission and, therefore, needs more fuel mixture in order to ensure a quick response to acceleration than the manual transmission. It is also apparent from FIG. 5, that the lower the temperature of engine coolant Te becomes, the lower the specific value Th is. For this reason, as shown in FIGS. 7 and 8, the number of executions of asynchronous fuel injection is higher before than after the engine has warmed up for a given change of intake air amount ΔVs per unit time before and after the engine has warmed up.

Figure 6:
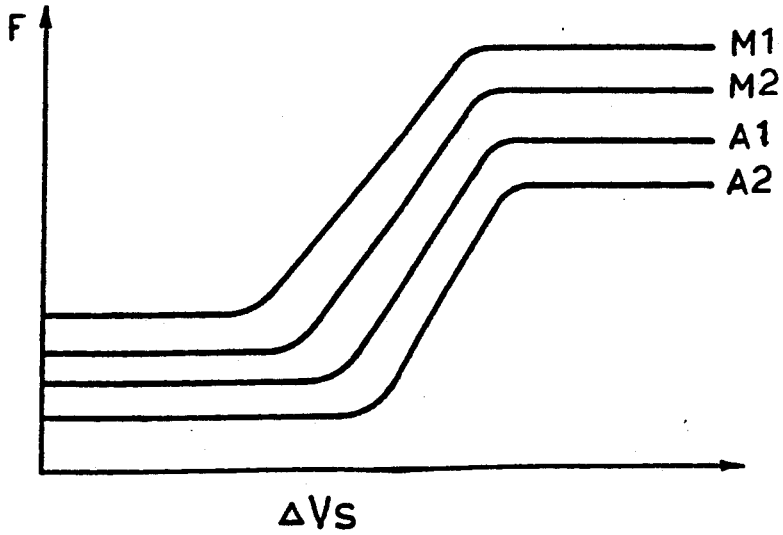
FIG. 6 is a diagram showing the relationship of an amount of injected fuel relative to a change of intake air amount for various engine operating conditions.

Referring to FIG. 4, which is a flow chart of the asynchronous fuel injection sequence, the first step in step S31 is to make a decision as to whether the transmission 2 is automatic (A/T) or manual (M/T) in order to calculate the amount of fuel, F, in asynchronous fuel injection in step S32 or S33. The amount of fuel F in asynchronous fuel injection is calculated in step S32 if the answer to the decision indicates that the transmission 2 is manual (M/T) or in step S33 if the answer to the decision indicates that the transmission 2 is automatic (A/T). For the calculation of the amount of fuel according to a change of intake air amount ΔVs per unit time for every asynchronous injection, a map shown in FIG. 6 is prepared. In FIG. 6, curves M1 and M2 are used for the manual transmission, and curves A1 and A2 are used for the automatic transmission. The curve M1 or A1 gives the amount of fuel in asynchronous fuel injection when fuel is injected without any increase after the engine has started, while the curve M2 or A2 gives the amount of fuel in asynchronous fuel injection when fuel is injected with an increase after the engine has started.

After the calculation of the amount of fuel, F, in asynchronous fuel injection in step S32, or S33, a decision is made in step S34 as to whether a current amount of fuel Fc is equal or larger than a previous amount of fuel Fp. Taken as an eventual amount of fuel is the current amount of fuel Fc, if it is equal to or larger than the previous amount of fuel Fp, in step S35, or the previous amount of fuel Fp, if the current amount of fuel Fc is smaller than the previous amount of fuel Fp, in step S36. Thereafter, a decision is made in step S37 to test an asynchronous fuel injection flag AFI to determine whether the asynchronous fuel injection conditions are satisfied and, if the decision made in step S37, the asynchronous fuel injection is executed in step S38. Either after the execution of the asynchronous fuel injection in step S38 or, if the asunchronous fuel injection flag AFI is down and the decision made in step S37 is no the asynchrounous fuel injection sequence orders return to the first decision in step S31.

As is apparent from the description of the fuel control system according to the preferred embodiment of present invention, the asynchronous fuel injection is executed when the change of intake air amount ΔVs per the unit time reaches a critical level, or the specific value Th, so as to increase the amount of fuel to be injected, and the fuel mixture is prevented from temporarily becoming lean upon acceleration. Because the critical level or the specific value Th is set higher when the engine has warmed up, the asynchronous fuel injection is executed upon rapid acceleration or the like only, thereby avoiding an unnecessary increase of fuel so as to prevent the fuel mixture from becoming overly rich. Furthermore, because the critical level or the specific value Th is set lower when the engine has not warmed up, the asynchronous fuel injection is executed even upon starting or quick and slight acceleration so as to increase the amount of fuel to be inejction, thereby preventing fuel mixture from becoming lean, so as to improve the responsiveness of the acceleration.

It is apparent from the above description that the asynchronous injeciton judgement sequence and asynchronous fuel injection sequence shown in FIGS. 2 and 4, respectively, act as fuel increase means which controls the fuel injector 14 so as to increase the amount of fuel to be injected when the air-flow sensor 12, acting as an acceleration detector detects that the change of intake air amount per unit time has reached a critical level. The specific value setting sequence shown in FIG. 3 acts as critical level change means for setting a lower critical level in the fuel increase means when a temperature sensor, such as the engine coolant temperature sensor 43, detects that the engine has warmed up.

It is to be understood that although the invention has been described in detail with respect to a preferred embodiment, nevertheless, various other embodiments and variants are possible which are within the spirit and scope of the invention, and such are intended to be covered by the following claims.

What is claim is:

1. A fuel control system for an automotive engine, comprising:

fuel injection means for injecting a properly controlled quantitiy of fuel into cylinders of said automotive engine ;

engine control value detection means for detecting an engine control value which varies with a speed of rotation of said automotive engine;

a temperature sensor for detecting a temperature of said automotive engine; and a control unit for (a) determining if said temperature is lower than a preselected temperature, (b) determining whether said engine control value is at least equal to a specific value, (c) calculating, when said engine control value is at least enqual to said specific value, a current amount of fuel according to said engine control value, and using, as said properly controlled quantity of fuel, said current amount of fuel when said current amount of fuel is equal to or larger than a previously calculated amount of fuel and said previously calculated amount of fuel when said current amount of fuel is smaller than said prevously calculated amount of fuel, (d) causing said fuel injection means to inject the properly controlled quantity of fuel into said cylinders when said temperature is not lower than said preslected temperature and said engine control value detection means detects that said engine control value is at least equal to said specific value, and (e) decreasing said specific value as said temperature sensor detects lower temperatures.

2. A fuel control system as defined in claim 1, wherein said engine control value detection means is an air flow meter for detecting an increase of intake air to be delivered into said cylinders.

3. A fuel control system as defined in claim 1, wherein said control unit changes said critical level substantially linearly according to changes in said temperature of said automotive engine

4. A fuel control system as defined in claim 1, wherein said temperature sensor detects a temperature of engine coolant.

5. A fuel control system as defined in claim 1, wherein a type of transmission coupled to said automotive engine is determined, and said control unit changes said specific value differently according to the type of transmission coupled to said automotive engine.

6. A fuel control system as defined in claim 5, wherein said control unit changes said specific value so that it becomes lower for an automatic type of transmission than for a manual type of transmission.

7. A fuel control system as defined in claim 6, and further comprising means for detecting a load on said automotive engine, said control unit disabling determination of whether siad engine control value is at least equal to said specific value if engine load disappears after a predetermined time period when a manual type of transmission is detected.

8. A fuel control system as defined in claim 6, wherein said engine control value detection means is an air flow meter for detecting an increase of intake air to be delivered into said cylinders.

9. A fuel control system as defined in claim 6, wherein said control unit changes said critical level substantially linearly according to changes in said temperature of said automotive engine.

10. A fuel control system as defined in claim 6, wherein said temperature sensor detects a temperature of engine coolant.

* * * * *